US005385326A

United States Patent [19]

Bidwell

[11] Patent Number: 5,385,326

[45] Date of Patent: Jan. 31, 1995

[54] OBJECT CONFIGURATION FOR UNIQUELY STACKING SAME

[75] Inventor: Christopher C. Bidwell, Dunwoody, Ga.

[73] Assignee: Circle R Central, Inc., Norcross, Ga.

[21] Appl. No.: 88,796

[22] Filed: Jul. 8, 1993

[51] Int. Cl.[6] ..... A47G 29/00

[52] U.S. Cl. ..... 248/346.1; 220/4.26; 248/908

[58] Field of Search ..... 248/346.1, 159, 346, 248/908; 211/194; 220/4.26, 4.27, 23.6, 906, 907

[56] References Cited

U.S. PATENT DOCUMENTS

| | | | |
|---|---|---|---|
| Re. 29,415 | 9/1977 | Ricobene | 206/550 |
| D. 166,368 | 4/1952 | Wenander | D58/15 |
| D. 229,270 | 11/1973 | Press | D7/45 |
| D. 236,576 | 9/1975 | Press | D7/45 |
| D. 257,419 | 10/1980 | Russell | D7/45 |
| D. 259,758 | 7/1981 | Marquardt | D7/45 |
| 315,917 | 4/1885 | Dean | 220/4.26 |
| 464,494 | 12/1891 | Cline | 211/194 |
| 1,886,109 | 11/1932 | L'Enfant | 220/4 |
| 1,981,627 | 11/1934 | Merriman | 248/346.1 |
| 2,645,375 | 7/1953 | Töpfer | 220/4.27 |
| 3,013,688 | 12/1961 | Luning | 248/346.1 X |
| 3,161,315 | 12/1964 | Braun | 220/4.26 |
| 3,369,691 | 2/1968 | Wei | 220/4.27 |
| 4,203,525 | 5/1980 | Okubo | 220/4.26 |

*Primary Examiner*—Karen J. Chotkowski
*Attorney, Agent, or Firm*—Troutman Sanders

[57] ABSTRACT

The invention relates to stackable coasters utilizing a tab and groove mechanism on its lower outside and upper inside side portions, respectively. The tab may consist of protrusions, keys, detents, or the like on the bottom portions of the coasters and grooves consisting of depressions, indentations, keyways, notches or the like on the top portions of the coasters. The tab and groove mechanism guarantees that only one specific coaster may be stacked above or below another particular coaster. Moreover, the tabs and grooves further ensure that the sides of each stacked coaster are radially positioned identically each time relative to the sides of the coaster above and/or the coaster below it. This tab and groove feature, thereby, allows a particular image, design, or picture to be displayed from the sides of the set of coasters every time when each coaster is stacked in its proper angular position. Finally, the tab and groove mechanism also permits a particular shaped object to be formed every time when the coasters are properly stacked.

22 Claims, 3 Drawing Sheets

OBJECT CONFIGURATION FOR UNIQUELY STACKING SAME

BACKGROUND OF THE INVENTION

1. Technical Field

This invention relates generally to stackable objects, and in particular, to the configuration of objects which allows the objects to be stacked in a unique manner, both radially and sequentially.

2. Description of the Prior Art

It is advantageous to stack certain types of objects for purposes of storing the same. For example, coasters are objects commonly used as an intermediary between a table and a glass or other holder of liquids, and have traditionally been stored while not in use by stacking one coaster on top of another coaster. In this way, a minimum of table or shelf space is used, while allowing the coasters to be stored in an organized and efficient manner. Stacking of objects such as coasters has also been performed in order to achieve a certain aesthetic or ornamental effect. Examples of prior utility and design patents directed to stackable coasters include: U.S. Pat. Nos. 1,981,627; Des. 166,368; Des. 236,576; Des. 229,270; Des. 257,419; and Des. 259,758.

While prior useful and ornamental designs for coasters have allowed coasters to be successfully stacked, no such known design has been developed which would allow coasters (or other objects) to be stacked only in a preselected order, and at a preselected angular position with respect to one another, in order to create a composite object. The advantages of such a configuration are numerous, and include: allowing a particular image, design or picture to be displayed on the sides of the composite object; and allowing a particular shaped composite object to be formed when the constituent objects are properly stacked.

SUMMARY OF THE INVENTION

The present invention recognizes and addresses the foregoing disadvantages, and others of prior art constructions and methods.

Accordingly, it is an object of the present invention provide an improved object stacking system.

It is another object of the present invention to provide an improved coaster stacking system.

It is another object of the present invention to provide a system for stacking objects, such as coasters, in a preselected order.

It is another object of the present invention to provide a system for stacking objects, such as coasters, with a preselected angular relation to one another.

It is another object of the present invention to provide a system for stacking objects, such as coasters, in a way so as to reveal an image, design or picture located on the sides of all of the coasters.

It is another object of the present invention to provide a system for stacking objects, such as coasters, in a way so as to reveal an a particular shaped object formed from all of the coasters.

Generally speaking, the invention relates to a set of stackable coasters. According to the present invention, the set of stackable coasters comprises a top coaster having a shaped bottom surface and a bottom coaster having a shaped top surface. The set of stackable coasters also comprises at least one intermediate coaster disposed between the top coaster and the bottom coaster. Each intermediate coaster has a shaped top surface and a shaped bottom surface opposite the shaped top surface. Each of the shaped surfaces includes a mating element for allowing stacking of the coasters in only one predetermined sequence and for allowing adjacent coasters to be stacked in only one single predetermined radial position with respect to each other.

The invention also relates to a top coaster for use within a set of stackable coasters. The top coaster has a shaped bottom surface having a mating element disposed thereon for allowing stacking of the top coaster on only one other coaster in the set and for allowing the top coaster to be stacked in only one single predetermined radial position with respect to the other coaster.

Additionally, the invention relates to an intermediate coaster for use within a set of stackable coasters. The intermediate coaster is positioned between top and bottom coasters of the set and comprises a shaped top surface and a shaped bottom surface opposite the shaped top surface. Each of the surfaces includes a mating element for allowing stacking of the set of coasters in only one predetermined sequence and for allowing adjacent coasters to be stacked in only one single predetermined radial position with respect to each other.

Finally, the invention also relates to a bottom coaster for use within a set of stackable coasters. The bottom coaster has a shaped top surface having a mating element ordering disposed thereon for allowing stacking of only one other coaster in the set on the bottom coaster and for allowing the other coaster to be stacked in only one single predetermined radial position with respect to the bottom coaster.

More specifically, the invention relates to stackable coasters utilizing a tab and groove mechanism on its lower outside and upper inside side portions, respectively. The tab may consist of protrusions, keys, detents, or the like on the bottom portions of the coasters and grooves consisting of depressions, indentations, keyways, notches, or the like on the top portions of the coasters. The tab and groove mechanism guarantees that only one specific coaster may be stacked above or below another particular coaster. Moreover, the tabs and grooves further ensure that the sides of each stacked coaster are radially positioned identically each time relative to the sides of the coaster above and/or the coaster below it. This tab and groove feature, thereby, allows a particular image, design, or picture to be displayed from the sides of the set of coasters every time when each coaster is stacked in its proper angular position. Finally, the tab and groove mechanism also permits a particular shaped object to be formed every time when the coasters are properly stacked.

In a first embodiment, two tabs extending downward on the bottom exterior side portion of a top coaster and are positioned a particular distance from each other such that they match up with two depressions extending upward on the top interior side portion of a bottom adjacent coaster.

The stacking sequence of the coasters can also be achieved in alternative embodiments by matching a specific geometry of a single tab extending from the bottom exterior side of a first coaster with the geometry of a mating groove on a top portion a second coaster immediately below the first coaster. Further, the groove may consist of a notch on the top of the coaster, visible on both the interior and exterior of the coaster with the matching on a lower exterior of the coaster.

Alternatively, the tab may exist on either one of the upper interior or lower exterior of the coaster, with the corresponding depression on the lower exterior of the coaster or the upper interior of the coaster, respectively.

Optimally, only one specific top coaster and one specific bottom coaster are matingly engagable within the set of coasters. Therefore, since each coaster can be a top and a bottom coaster relative to another coaster, by staggering the distances of the tabs and corresponding grooves or by providing for specific corresponding geometries between mating tabs and grooves for adjacent coasters, the coasters may be stacked such that the set of coasters produce an image or a shape. Some examples of images include, pictures of a flag or cartoon characters running along the side of the set of coasters, and the shape of a beverage can with pertinent insignia incorporated into the side of the set of coasters.

Other objects, features and aspects of the present invention are discussed in greater detail below.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying figures, in which.

Figure 1:
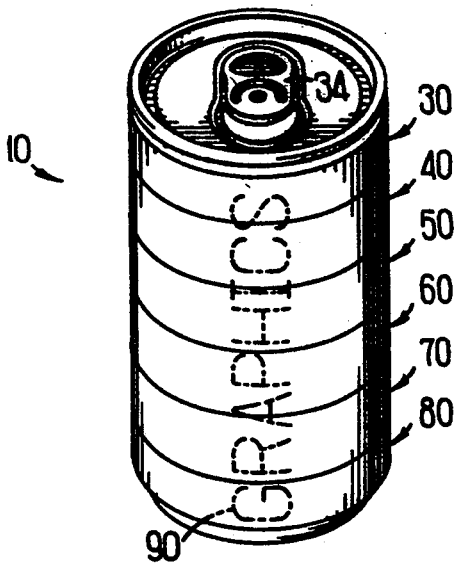
FIG. 1 is a perspective view of stacked coasters according to the present invention.

Repeat use of reference characters in the present specification and drawings is intended to represent same or analogous features or elements of the invention.

DETAILED DESCRIPTION OF THE INVENTION

Figure 2:
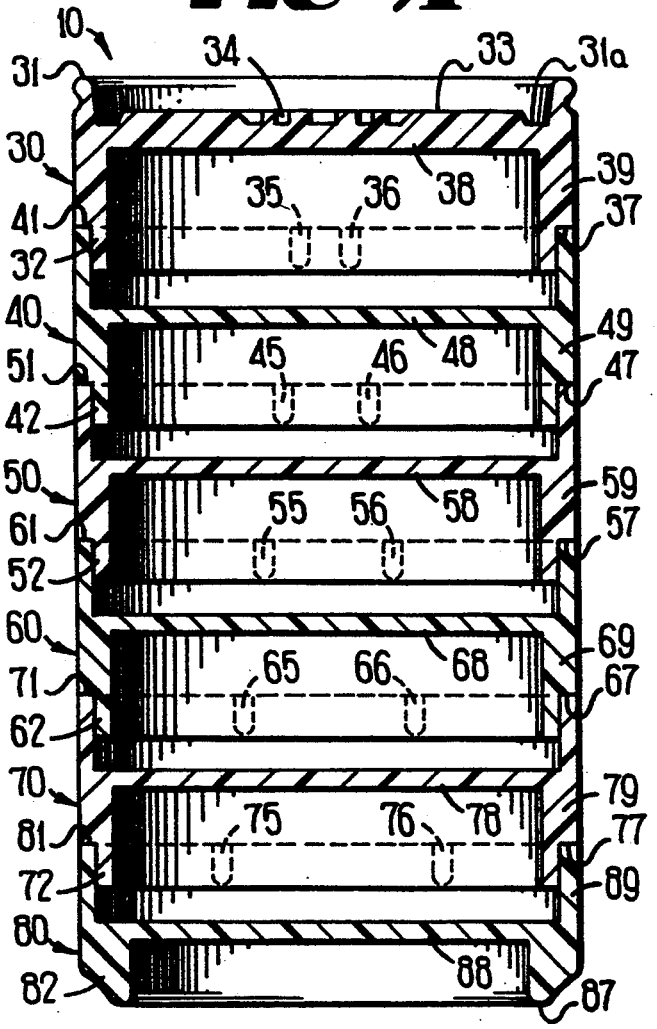
FIG. 2 is a cut-away view of the stacked coasters of FIG. 1 according to a first embodiment of the present invention.
Figure 3:
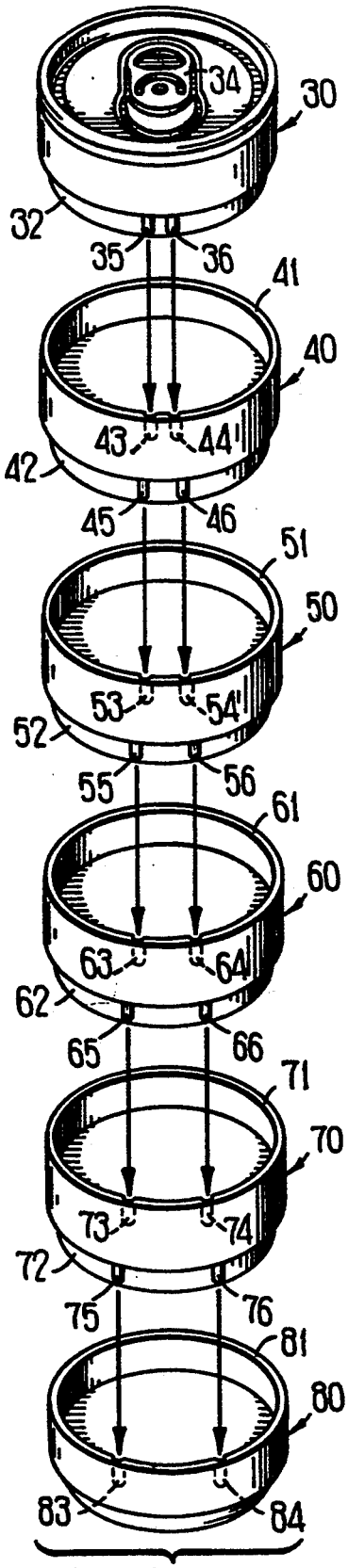
FIG. 3 is an exploded view of stacked coasters of FIG. 1 according to a first embodiment of the present invention.

Referring to FIGS. 1, 2 and 3, a stack of coasters 10 is in the form of a beverage can when fully stacked with an appropriate graphics design on an outer portion thereof. Coaster 80 forms the base of the stack 10 and has coasters 70, 60, 50, and 40, in order, stacked upon it. At the top of the stack is coaster 30, the surface 33 of which has top annular surface 31, annular depression 31*a* and tab imitation means 34 disposed thereon. When coaster 30 is placed on the stack 10 of the coaster it resembles a beverage can as illustrated in FIG. 1.

Referring to FIG. 2, the stack 10 of coasters is shown in cross-section. Each coaster is essentially comprised of annular walls 39, 49, 59, 69, 79, 89, extending above and below flat surfaces 38, 48, 58, 68, 78, and 88. On a lower portion of walls are recesses, 32, 42, 52, 62, 72, and 82 defined by surfaces 37, 47, 57, 67, 77, and 87. These recesses comprise lateral stabilization means as is further described herein. The recesses are used in stacking the coasters when not in use. As is seen in FIGS. 2 and 3 each of recesses 32, 42, 52, 62, and 72 fit within annular walls 49, 59, 69, 79, and 89 respectively, since the inner diameter of each annular wall is slightly greater than the outside diameter of each lower recess. For vertical support each of bottom annular surfaces 37, 47, 57, 67, and 77 rest upon top annular surfaces 41, 51, 61, 71, and 81 respectively, allowing lateral stabilization of the stack of coaster 10.

Coaster 30, as shown in FIGS. 1 and 3, resembles the top of a beverage can. Tab imitation means 34 is recessed within surface 33 and is centered within annulus 31 on coaster 30. Since no coasters are stacked above coaster 30, it has only tabs 35 and 36 disposed on recess 32. The bottom coaster 80 resembles the bottom portion of the beverage can. Recess 82 is tapered in a manner similar to a standard beverage can and lacks any tabs thereon. As is seen in FIGS. 2 and 3 on an upper portion of coaster 80 has grooves 83 and 84 thereon for receiving tabs 75 and 76.

Radial stabilizing and ordering means for each embodiment of the set of coasters are described in more detail below. Referring to FIGS. 2 and 3, a first embodiment of the radial stabilizing and ordering means is illustrated. In this embodiment the tabs and grooves are hidden when the stack is assembled. As seen in FIG. 3, grooves 83 and 84 on bottom coaster 80 are positioned a particular distance from one another such that they match up with tabs 75 and 76 on coaster 70. These grooves and tabs are uniquely paired such that coaster 70 can only be stacked upon coaster 80. Similarly, tabs 65 and 66 on coaster 60 are uniquely paired with grooves 73 and 74, respectively, on coaster 70 to insure that coaster 60 can only be placed upon coaster 70. Similarly tabs 55 and 56 are uniquely paired with grooves 63 and 64, 45 and 46 with 53 and 54, and 35 and 36 with 43 and 44 to insure the proper stacking order. As is illustrated in FIGS. 2 and 3 the spacing between pairs of grooves and respective tabs progressively decreases from the bottom to the top of stack 10. This arrangement serves several purposes. First, it insures proper stacking order for the coasters and second, it assures that the coasters will not shift radially with respect to another, so that graphics displayed on an outer portion of coaster stack 10 will be properly assembled.

Figure 4:
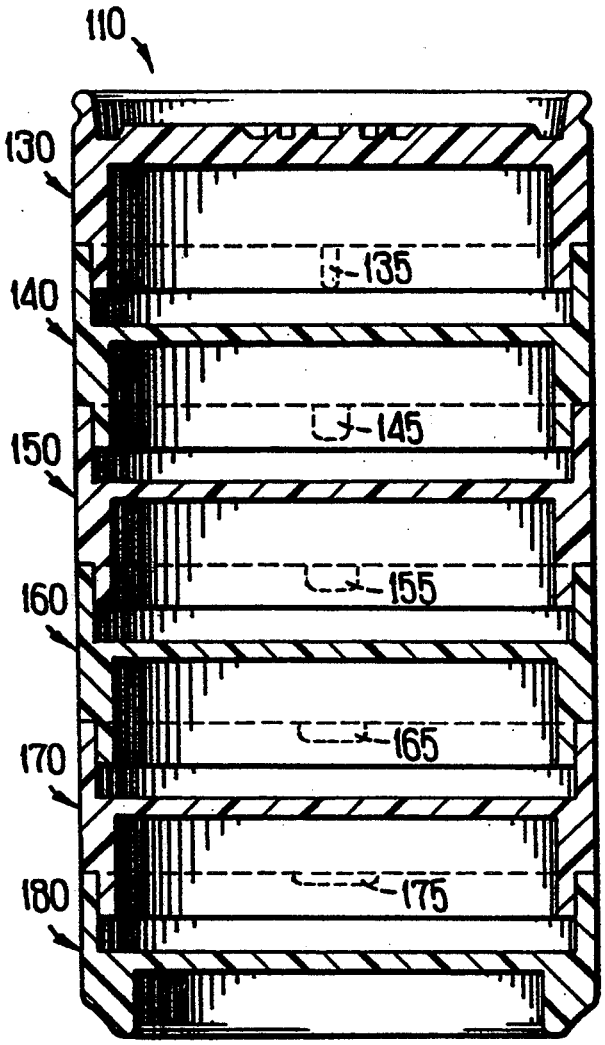
FIG. 4 is a cut-away view of the stacked coasters of FIG. 1 according to a second embodiment of the present invention.
Figure 5:
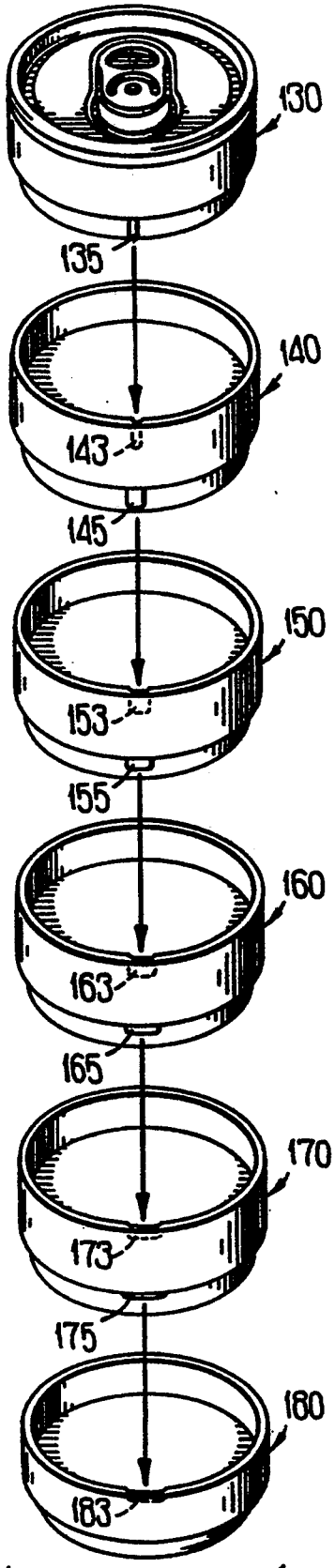
FIG. 5 is an exploded view of stacked coasters of FIG. 1 according to a second embodiment of the present invention.

FIGS. 4 and 5 illustrate a second embodiment of the present invention. This embodiment also conceals the tabs and grooves. Here coasters 170, 160, 150, 140, and 130 have only single tabs 175, 165, 155, 145 and 135, mating with grooves 183, 173, 163, 153, and 143, respectively, to form radial stability and ordering means. As is illustrated in FIGS. 4 and 5, tab 175 mates within grooves 183 only; similarly 165 with 173, 155 with 163, 145 with 153, and 135 within 143. In this particular embodiment, the stacking order is achieved by varying the length width of the tabs and corresponding grooves. As seen in FIGS. 4 and 5, the width of the grooves and corresponding tabs decreases with each successive pair of coasters in the stacking order. Also, the length of the grooves and corresponding tabs increases with each successive pair of coasters in the stacking order, thereby insuring ordered stacking of the coasters so that appropriate insignia on the stack 10 is properly displayed.

Figure 6:
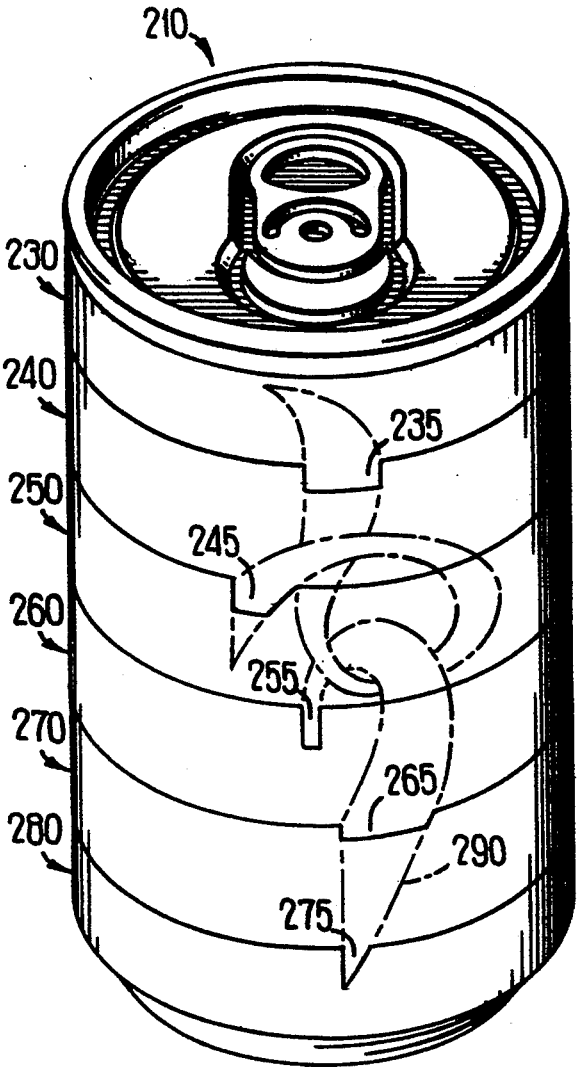
FIG. 6 is a perspective view of the stacked coasters according to a third embodiment of the present invention.
Figure 7:
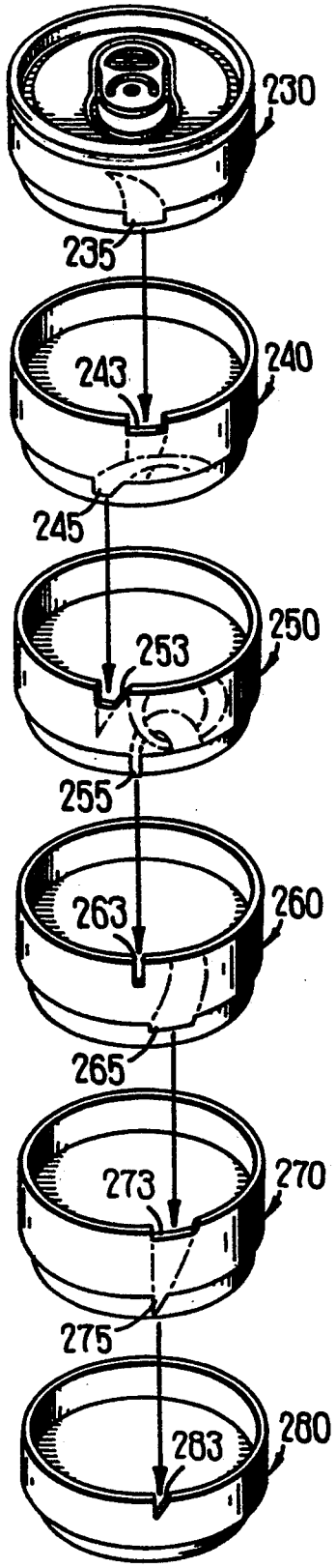
FIG. 7 is an exploded view of stacked coasters of FIG. 6 according to a third embodiment of the present invention.

FIGS. 6 and 7 illustrate a third embodiment of the present invention. This embodiment allows the tabs to be visible on the outer portion of the stack and, more particularly, to be incorporated within the graphics or insignia on the outside of the stack. FIG. 6 illustrates the stack wherein tabs 235, 245, 255, 265, and 275 are flush with the outer periphery of the annular walls and are incorporated into the generic graphics, image, or insignia 290 displayed on the stack. As seen in FIG. 7, the grooves 283, 273, 263, 253, and 243 are incorporated as notches into the upper annular surface of coasters 280, 270, 260, 250, and 240. This arrangement provides for ordering and radial stability of each coaster with respect to adjacent coasters. Specifically, v-shaped tab 275 fits with corresponding depression 282, 265 with 272, 255 with 262, 245 with 252, and 235 with 242. Each pair has a distinctive shape thereby insuring proper order when the coasters are stacked. Each pair may be of any appropriate shape.

It should be appreciated by those skilled in the art that grooves for radial stability and ordering of the coasters may be placed on an upper, lower, inner, or outer portion of the coaster. Also, the corresponding tabs may be placed on lower, upper, inner or outer portion of the coaster. Further, any number of depressions and mating tab pairs can be utilized for this purpose. Moreover, the tabs and corresponding grooves may be of any appropriate shape so long as the insure the stacking order and radial stability of the coasters. These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to be limitative of the invention so further described in such appended claims.

What is claimed is:

1. A set of stackable coasters comprising:

a top coaster having a shaped bottom surface;

a bottom coaster having a shaped top surface;

at least one intermediate coaster disposed between said top coaster and said bottom coaster including a shaped top surface and a shaped bottom surface opposite said shaped top surface; and each said surface including stacking means allowing stacking of said coasters in only one predetermined sequence and for allowing adjacent coasters to be stacked in only one single predetermined radial position with respect to each other.

2. A set of stackable coasters according to claim 1 further comprising an image portion on an outer surface of each said coaster whereby when said coasters are stacked a complete image is formed comprising said image portions.

3. A set of stackable coasters according to claim 2 wherein said stacking means includes a tab located on an outer periphery of each said coaster having an image portion which forms a portion of said complete image.

4. A set of stackable coasters according to claim 1 whereby when the coasters in said set are stacked together a stack is formed resembling a beverage container.

5. A set of stackable coasters according to claim 1 wherein a bottom portion of said bottom coaster resembles a lower portion of a beverage container.

6. A set of stackable coasters according to claim 1 wherein said stacking means comprises:

a shaped portion of each said shaped top surface complimentary in shape to a shaped portion of a single corresponding bottom surface; and a shaped portion of each said shaped bottom surface complimentary in shape to a shaped portion of a single corresponding top surface.

7. A set of stackable coasters according to claim 6 wherein said shaped top portion comprises a groove and said bottom portion comprises a tab.

8. A set of stackable coasters according to claim 7 wherein said shaped top portion comprises a plurality of grooves with predetermined spacing therebetween and said bottom portion comprises a plurality of tabs with corresponding spacing therebetween.

9. A set of stackable coasters according to claim 6 wherein said shaped top portion comprises a tab and said bottom portion comprises a groove.

10. A set of stackable coasters according to claim 9 wherein said shaped top portion comprises a plurality of tabs with predetermined spacing therebetween and said bottom portion comprises a plurality of grooves with corresponding spacing therebetween.

11. A set of stackable coasters according to claim 6 wherein said shaped top portion comprises a tab of predetermined width and said bottom portion comprises a groove of corresponding width.

12. A set of stackable coasters according to claim 6 wherein said shaped top portion comprises a groove of predetermined width and said bottom portion comprises a tab of corresponding width.

13. A set of stackable coasters according to claim 6 wherein said shaped top portion comprises a tab of predetermined length and said bottom portion comprises a groove of corresponding length.

14. A set of stackable coasters according to claim 6 wherein said shaped top portion comprises a groove of predetermined length and said bottom portion comprises a tab of corresponding length.

15. A top coaster for use within a set of stackable coasters including a bottom coaster and at least one intermediate coaster, said top coaster comprising:

a shaped top surface and a shaped bottom surface opposite said top surface; and said bottom surface including a mating element for allowing stacking of said top coaster on only a single other coaster in said set and for allowing said top coaster to be stacked in only one single predetermined radial position with respect to said single other coaster.

16. The top coaster of claim 15 wherein said shaped top surface resembles an upper portion of a beverage container.

17. The top coaster of claim 15 wherein said mating element includes at least one tab.

18. An intermediate coaster for use within a set of stackable coasters including a bottom coaster and a top coaster, said intermediate coaster comprising:

a shaped top surface and a shaped bottom surface opposite said shaped top surface; and each said surface including a mating element for allowing stacking of intermediate coasters in only one predetermined sequence and for allowing adjacent intermediate coasters to be stacked in only one single predetermined radial position with respect to each other.

19. The intermediate coaster of claim 18 wherein said mating element on said shaped top surface includes at least one groove and said mating element on said shaped bottom surface includes at least one tab.

20. A bottom coaster for use within a set of stackable coasters including a top coaster and at least one intermediate coaster, said bottom coaster comprising:

a shaped top surface and a shaped bottom surface opposite said top surface; and said top surface including a mating element for allowing stacking of only a single other coaster in said set on said bottom coaster and for allowing said single other coaster to be stacked in only one single predetermined radial position with respect to said bottom coaster.

21. The bottom coaster of claim 20 wherein said shaped bottom surface of said bottom coaster resembles a lower portion of a beverage container.

22. The bottom coaster of claim 20 wherein said mating element includes at least one groove.

* * * * *